US007500344B2

(12) United States Patent
Badiali et al.

(10) Patent No.: US 7,500,344 B2
(45) Date of Patent: Mar. 10, 2009

(54) DEVICE FOR HANDLING THE YARN IN SERVICE TROLLEYS FOR OPEN-END SPINNING FRAMES

(75) Inventors: Roberto Badiali, Pordenone (IT); Vittorio Colussi, Treviso (IT); Donato Castellarin, Pordenone (IT)

(73) Assignee: Savio Macchine Tessili S.p.A., Pordenone (IT)

( * ) Notice: Subject to any disclaimer, the term of this patent is extended or adjusted under 35 U.S.C. 154(b) by 0 days.

(21) Appl. No.: 11/388,367

(22) Filed: Mar. 24, 2006

(65) Prior Publication Data

US 2006/0225398 A1 Oct. 12, 2006

(30) Foreign Application Priority Data

Apr. 11, 2005 (IT) ..... MI2005A0605

(51) Int. Cl.
*B65H 69/06* (2006.01)

(52) U.S. Cl. ..... 57/22; 57/263

(58) Field of Classification Search ..... 57/22, 57/261, 263, 279

See application file for complete search history.

(56) References Cited

U.S. PATENT DOCUMENTS

| | | | | |
|---|---|---|---|---|
| 5,327,712 | A * | 7/1994 | Dallmann et al. | 57/22 |
| 5,651,507 | A * | 7/1997 | Ruskens et al. | 242/475.6 |
| 5,765,770 | A * | 6/1998 | Hermanns et al. | 242/476 |
| 6,804,945 | B2 * | 10/2004 | Straaten | 57/263 |
| 2003/0038206 | A1 * | 2/2003 | Grecksch et al. | 242/475.6 |
| 2003/0070411 | A1 * | 4/2003 | Irmen et al. | 57/22 |
| 2005/0016156 | A1 * | 1/2005 | Brandl et al. | 57/279 |

* cited by examiner

*Primary Examiner*—Shaun R Hurley
(74) *Attorney, Agent, or Firm*—James V. Costigan; Hedman & Costigan, P.C.

(57) ABSTRACT

Device for generating and controlling a yarn reserve to be installed on service trolleys with open-end spinning frames, for reattachment and start-up interventions on the spinning unit, comprising a mouthpiece which sucks and generates in its interior a loop of reserve yarn, equipped, inside, with sensors for detecting the dimension of the loop of reserve yarn and consequently piloting the reattachment procedure and reconsignment of the bobbin to its standard functioning.

11 Claims, 4 Drawing Sheets

DEVICE FOR HANDLING THE YARN IN SERVICE TROLLEYS FOR OPEN-END SPINNING FRAMES

CROSS-REFERENCE TO RELATED APPLICATTONS

Not Applicable

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISK

Not Applicable

REFERENCE TO A MICROFICHE APPENDIX

Not Applicable

BACKGROUND OF THE INVENTION

1. Field of the Invention

The present invention relates to open-end spinning, i.e. rotor spinning.

2. Description of Related Art

Open-end spinning frames normally consist of a series of individual spinning units, aligned on the two fronts of the machine, each of which consists of a spinning rotor, which produces heald yarn starting from the single fibers of a sliver and from a collecting unit which—after controlling the quality of the yarn by interposing a slit plate between the two components—leads the yarn to wind on a winding tube to produce a tapered bobbin. This tapered bobbin is formed by pulling and winding the yarn on its surface, as it is rotated by the underlying roll on which the bobbin in formation rests. The yarn is wound in cross-coils on the rotating tapered bobbin, as the collecting unit is equipped with a yarn carrier which distributes the yarn, by means of an axial backward-and-forward movement, on the external surface of the tapered bobbin.

The structure of the individual spinning station is shown in the scheme of FIG. 1, and its functioning is briefly described hereunder according to its normal operating conditions.

Proceeding from below upwards, the spinning station 1 consists of the actual spinning unit 2, and the collecting unit 3, whose main components are briefly described hereunder, which transform the sliver with parallel fibres into yarn wound onto the tapered bobbin.

The feeding sliver S is housed in a cylindrical container 4 where it is deposited in a double spiral. The sliver S is fed to the unit by a feeding roll 5, passing through the funnel conveyor 6 and reaches the card 7, a rotating roll equipped with a clothing which makes the fibres of the sliver S singular and sends them, by suction, to the spinning rotor 8, which operates under depression.

The singularised fibers are deposited, by centrifugal effect, on the peripheral throat of the spinning rotor 8, which rotates at extremely high rates (up to 150,000 rev/minute and over); from here the fibers are collected and removed as a yarn F, axially leaving the central opening 9, receiving torsions from the rotation of the rotor itself, during the run between its inner throat and said opening 9, thus generating the twisted yarn F.

The withdrawal of the yarn is effected by a pair of opposing extraction cylinders 11 and 12, which seize the yarn F and operating at a controlled rate, according to the arrow a, thus determining the linear production of the yarn, normally expressed as m/min. The slit plate 14 for the control of the yarn F quality can be situated before the cylinders 11/12.

The yarn F thus produced enters the collecting unit 3, passes through a sensor 15 detecting the presence of the yarn and reaches a compensator 16 to compensate the length variations of the distance between the spinning unit 2 and the deposition point of the yarn F on the tapered bobbin. The yarn-carrier device 21 distributes the yarn on the tapered bobbin by transversally moving with a backward-and-forward motion according to the double arrow b, driven by a motor 20 which operates a longitudinal rod 22 in common with the other units of the spinning frame.

The tapered bobbin 25 collects the yarn F and is held by the bobbin-holder arm 26 equipped with two idle and openable counter-spikes 27, which are connected to the base tube 28 of the tapered bobbin. The tapered bobbin in formation 25 rests against its operating roll or collecting cylinder 29.

The automatic open-end spinning frames of a recent design are equipped with service trolleys which inspect the front lines of the spinning frame and automatically effect the necessary interventions stopping in front of the spinning unit which requires them.

There are essentially three types of required interventions:

starting operation, at the beginning of the spinning, when the spinning frame is still, starting it and subsequently placing a new yarning tube in each station, the start-up being effected by re-attachment with an auxiliary yarn and winding the yarn produced on the new tube, to give a tapered bobbin, after eliminating the section of auxiliary yarn;

re-attachment, when the yarn is interrupted for any reason, before reaching the envisaged length for completing the tapered bobbin, using the yarn already produced at the side of the tapered bobbin, effecting the re-attachment and restarting the winding on the same tapered bobbin. The re-attachment procedure consists, in its essential lines, in the opening, cleaning and closing of the rotor, in the preparation of the tail of the sliver, the capture and preparation of the end, at the side of the tapered bobbin, the re-starting of the rotor and feeding, the re-introduction in the rotor of the prepared end, the re-extraction of the end connected to the newly produced yarn, by winding it again in the collecting unit. The programmed cleaning cycle is equivalent to the re-attachment cycle, caused by a specific breakage of the yarn;

collecting, after reaching the desired length to complete the tapered bobbin. The finished tapered bobbin is discharged and the unit is then restarted as specified above.

These interventions of the controlling trolleys relate to both the collecting and starting or re-starting operations of the spinning station and to the repairing of yarn cuts due to natural causes or operated by the slit plates during the spinning.

In general, these interventions are effected by separating the tapered bobbin 25 from its operating cylinder 29, halting its movement and substituting the driving of the tapered bobbin 25 or its tube 28 by an auxiliary driving roll, positioned inside a service trolley.

In the field of devices and intervention procedures of service trolleys in automated open-end spinning frames, the Applicant owns, among others, the recent European patent applications nr. 04077813.6, 04077814.4, 040778818.5, 04077819.3, as well as patents EP 340,863, EP 443,220, EP 473,212.

Reference is made to these known technique references for greater details on the structure and functioning of these service trolleys.

A device and re-attachment procedure for obtaining—in said transitory phases—a yarn having good mechanical and aesthetical characteristics, is described in the previous European patent application 04077818.5. For the sake of brevity, reference should be made to this document, in which the whole trolley is described in great detail with respect to its components.

The intervention procedures carried out by service trolleys consist of a relevant number of phases effected from the trolley, interfacing it to the single unit or open-end spinning station with both its spinning rotor and overlying collecting unit, temporarily disconnecting these organs from their centralized driving units, and operating on the same with their own driving units, capable of bringing the spinning back to regime conditions, before re-activating the centralized commands and reconsigning the spinning unit to its normal centralized driving.

In the open-end technology, the main problem of high quality tapered bobbin winding, derives from the fact that the open-end yarn is produced and delivered to the collecting unit intrinsically at a constant linear rate with a collecting system and that the yarn tension must in any case, also during transitory phases, be controlled and maintained within pre-established ranges.

In a open-end spinning frame, the extraction rate of the yarn from the spinning rotor with extraction rolls or cylinders 11,12, is strictly constant—apart from the short re-attachment transitory—as is also the collecting rate. Considering that the driving units are in common and centralized and that differences can exist between units, either as a result of different advancement degrees of the tapered bobbin during production, or due to small geometrical or set-up differences between the spinning units, the open-end machine normally operates with a slight predominance of the collecting rate with respect to the yarn extraction rate, exploiting the elasticity of the yarn, thus generating a certain "reeling" tension: this rate difference is an adjustable parameter of the machine according to the operative conditions and has a value of a few units per thousand. This expedient is due to the requirement that a loosening of the yarn downstream of the extraction rolls 11,12 is not acceptable, otherwise causing problems of yarn control and the impossibility of forming a tapered bobbin having the required characteristics for its use, downstream of the spinning process.

Once the re-attachment has been successfully effected, the control and recovery phase of the yarn on the tapered bobbin 25 is of great importance, together with the re-consignment of the tapered bobbin itself from the auxiliary driving device situated in the service trolley to its normal driving roll 29 under regime conditions, which is part of the open-end spinning unit.

BRIEF SUMMARY OF THE INVENTION

The present invention relates to a trolley device which, during the re-attachment and collection cycles in the spinning start-up phase, generates a yarn reserve and provides this with a suitable tension for its new winding onto the tapered bobbin 25.

An objective of the present invention is to provide a yarn reserve which prevents risks of yarn tearing during the transitory phases, at the same time limiting to the utmost time wasting for the re-consignment of the tapered bobbin 25 to its roll 29.

In particular, the present invention improves the efficiency and duration of the intervention of the trolley, during the re-consignment phase of the tapered bobbin to the spinning unit, thus avoiding tearing of the yarn due to the imperfect alignment of the rate imparted to the tapered bobbin with the auxiliary roll of the trolley with that of the driving cylinder 29.

BRIEF DESCREPTION OF THE SEVERAL VIEWS OF THE DRAWINGS

DETAILED DESCRIPTION OF THE INVENTION

To more clearly illustrate the problems faced and the technical solutions proposed with the present invention, reference is made, in the following description, to a trolley in which the device according to the invention is inserted and the process is effected for re-consigning the tapered bobbin to its normal functioning according to the present invention, at the service of an open-end spinning frame, for illustrative and non-limiting purposes.

The device according to the invention is defined, in its main components, in the first claim, whereas its variations and preferred embodiments are specified and defined in the dependent claims.

The process according to the invention is defined, in its essential steps, in the ninth claim, whereas its variations are specified and defined in the subsequent dependent claims.

In order to present the characteristics and advantages of the present invention more clearly, the same is described with reference to its typical embodiment shown in the FIGS. 2, 3 and 4 for illustrative and non-limiting purposes.

Figure 1:
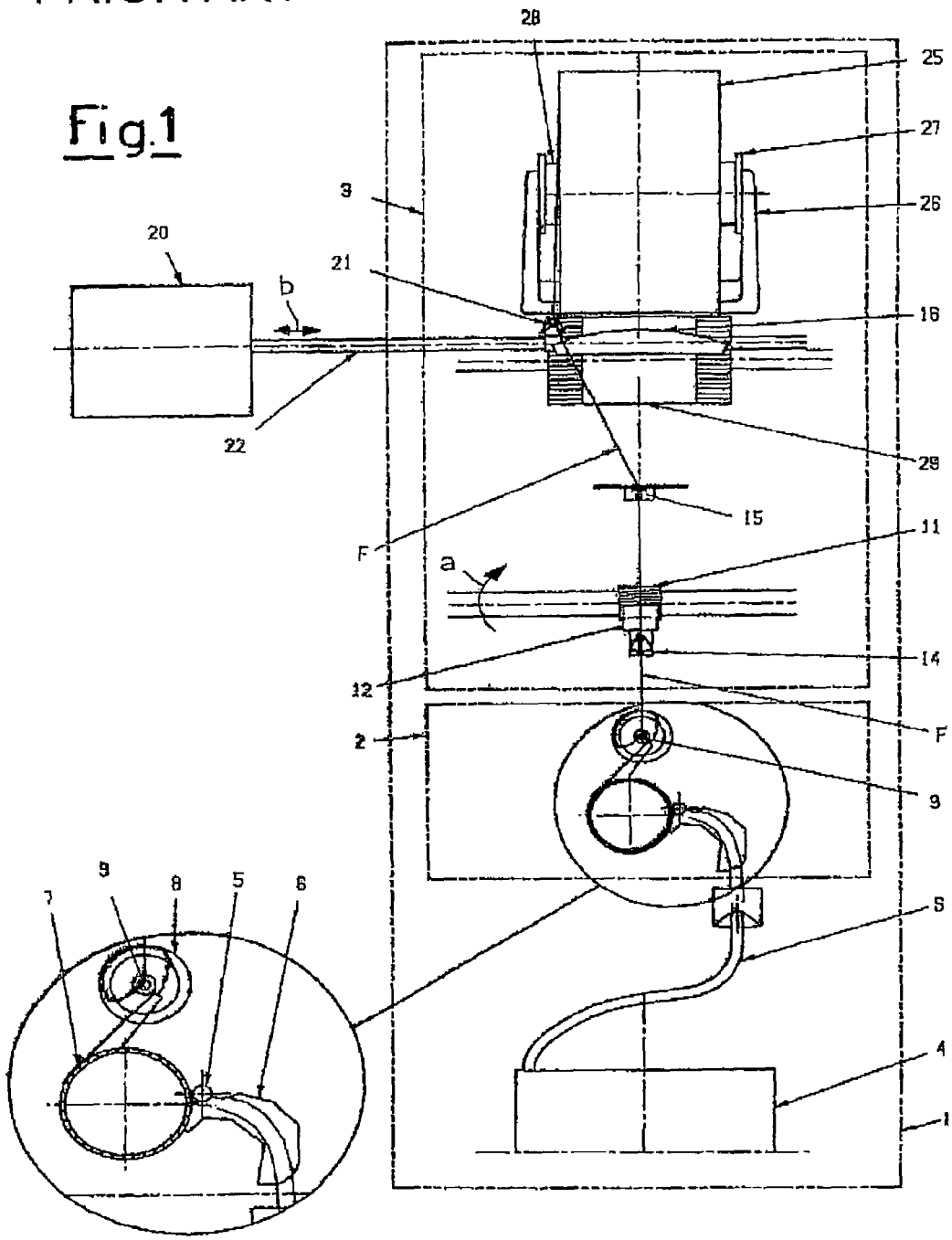
PRIOR ART Fig.1
FIG. 1 is a diagram of an open-end spinning station showing the most important components.

FIG. 1 shows a scheme of an open-end spinning station with its most important components, in a typical embodiment according to a front view, and which must be served by the trolley according to the subsequent figures.

Figure 2:
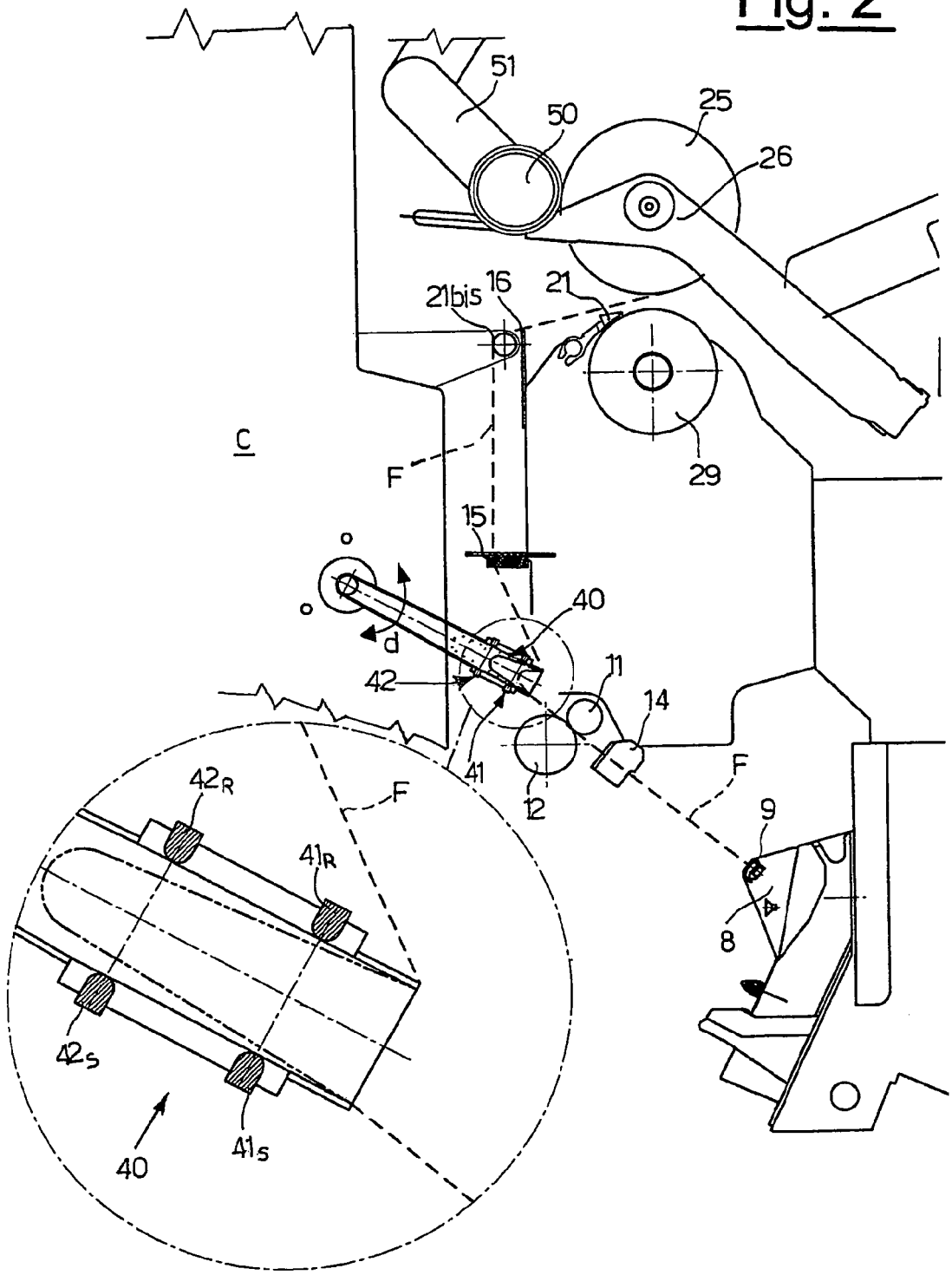
FIG. 2 shows a side view of a service trolley positioned in front of a spinning station of an open-end spinning machine.

FIG. 2 shows a service trolley C positioned in front of a spinning station of an open-end spinning frame, indicating the organs of the trolley C which intervene to effect the process according to the invention, as well as the device according to the invention for creating and handling a yarn reserve and providing it with the required tension for its re-winding onto the tapered bobbin 25.

The device according to the invention consists of a sucking mouthpiece 40 situated on the service trolley C, in which the shape and dimension of the yarn loop sucked inside, is controlled and determined. The particular characteristic of this sucking mouthpiece 40 consists of a series of sensors for detecting the presence of the yarn in its inside, so that the operating phases of the auxiliary roll 50 can be piloted, together with other parts of the service trolley, on the basis of the dimensions of the yarn loop sucked inside.

Figure 3:
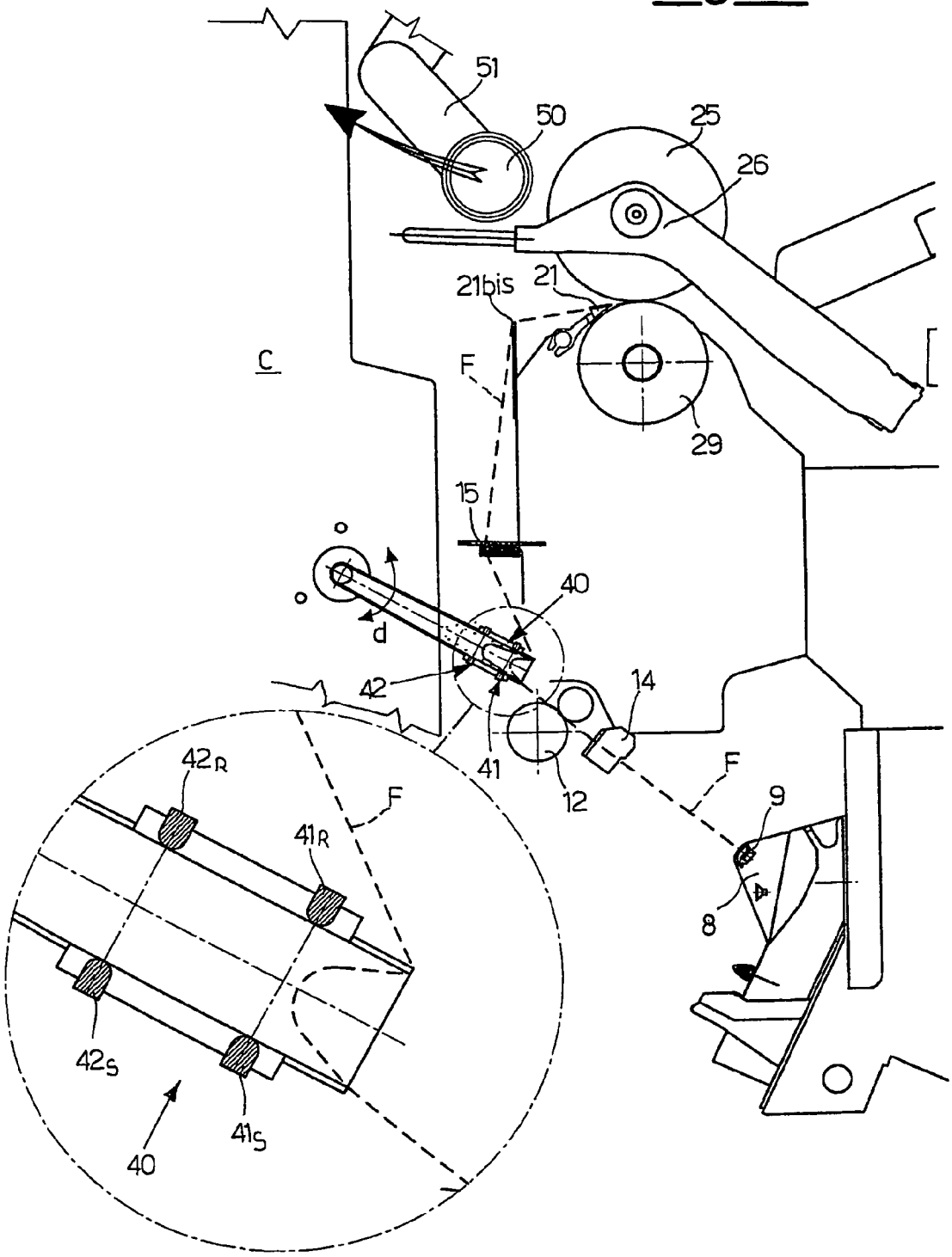
FIG. 3 is a side view of a service trolley which is engaged with a spinning station.
Figure 4:
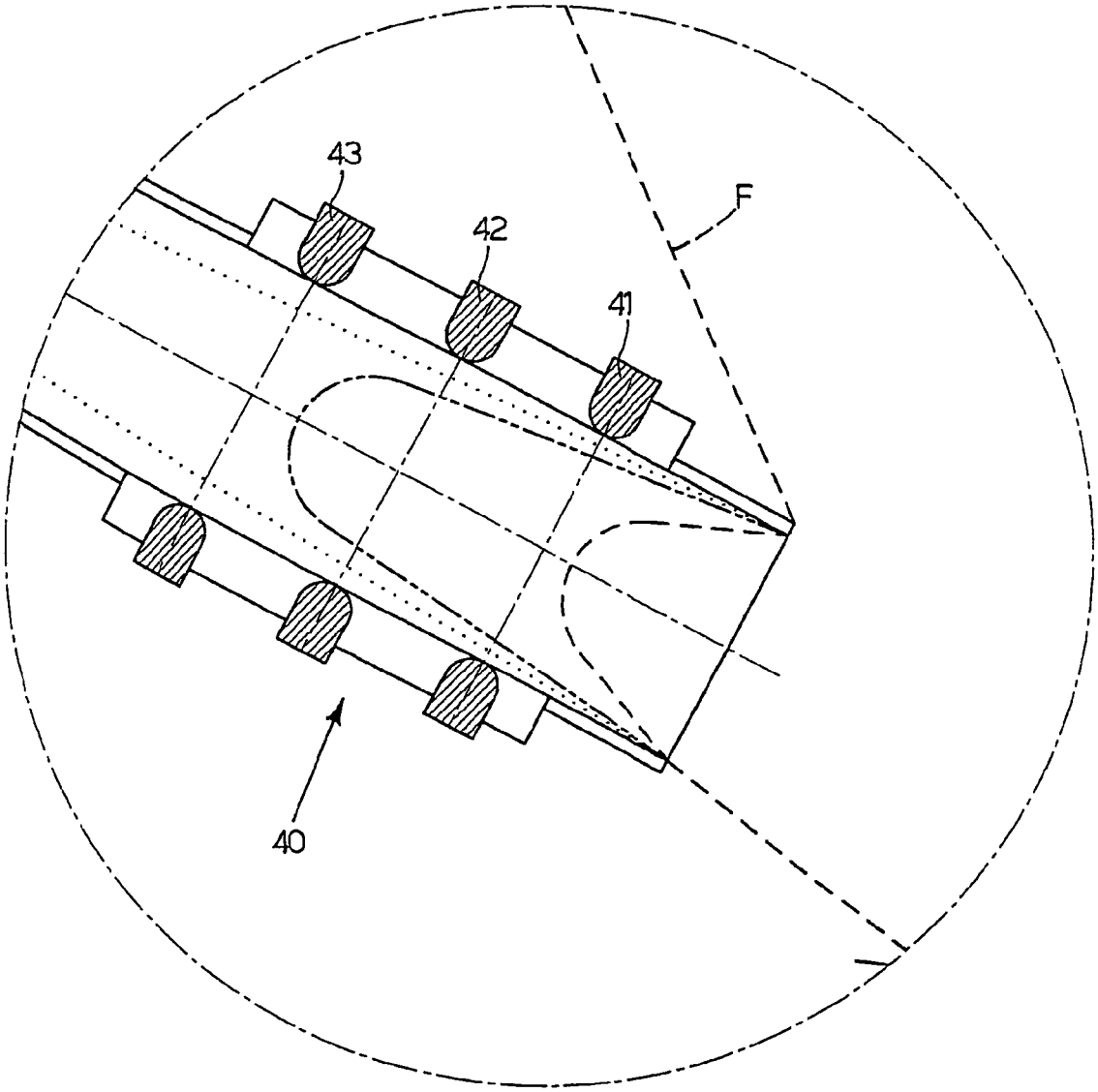
FIG. 4 is a enlarged view of the sensors positioned in proximity with the yarn.

In FIGS. 2, 3 and 4, the sensors are illustratively made up of pairs of elements, in which there is an optical sensor consisting of a source $\mathbf{41}_S$, $\mathbf{42}_S$ and a receiver $\mathbf{41}_R$, $\mathbf{42}_R$ respectively. The presence of the yarn is revealed when the reserve yarn F intercepts the optical path of the luminous signal emitted by the source $41_S$ and the receiver $41_R$ receives a reduced or disturbed signal with respect to the signal in the absence of yarn.

The auxiliary roll 50 is equipped with known means for the rotational driving of the tapered bobbin 25 or the new tube 28, according to a controlled clock/anticlockwise rotation to unwind/wind the yarn F during the service intervals, and it can be put in contact with the same, or moved aside, by moving its arm 51 forwards or backwards from the trolley C. The auxiliary roll 50 can be typically activated by means of a step-by-step motor piloted in frequency by the driving unit on the trolley.

The interventions of the service trolley C are effected by lifting and releasing the tapered bobbin 25 from its normal operating cylinder 29, and allowing the auxiliary roll 50 to take on the winding and unwinding operations, driven by the driving unit of the trolley.

FIG. 2 shows the open-end spinning station subjected to the intervention of the trolley; the tapered bobbin 25 has been lifted from its normal operational roll 29 and has been put in contact with the auxiliary driving roll 50 on the part of the trolley.

In FIG. 2, the course of the yarn F from the rotor 8 to the tapered bobbin 25 is shown at the outlet of the spinning rotor 9, through the slit plate 14 and the extraction rolls 11, 12. It then passes inside the yarn-presence sensor 15 and reaches an auxiliary yarn carrier 21*b* is which substitutes the yarn carrier 21 during the intervention of the trolley C: more details can be obtained from the co-pending European patent application 04077819.3.

During the intervention of said trolley C, the mouthpiece 40 is suitably moved closer to the run of the yarn F, in its tract between the extraction cylinders of rolls 11,12 and the yarn sensor 15. In particular, the roll 11 has motorized driving, whereas the roll 12 is idle and is pressed against the roll 11, which transmits rotation to the same. The approach and distancing means of the mouthpiece 40 can operate by rotation, for example according to the arrows d, and/or translation and are completely conventional. The mouthpiece 40 is connected to a depression generation system, which induces a significant sucking action therein.

The configuration of the mouthpiece 40 is shown more evidently with respect to its terminal part, in its enlarged detail of FIG. 2. It sucks in a certain amount of yarn F, whose value is measured by the yarn-presence sensors 41,42: the yarn loops can have different dimensions, for example a minimum dimension shown as a dashed line, an intermediate dimension shown as a dash-point line, a greater dimension shown as a dotted line, as illustrated in the enlarged detail of FIG. 4.

The sucking mouthpiece 40 accumulates the available amount of yarn in its interior and, as a result of the suction effect, keeps it extended inside, exerting a tension thereon in direct proportion to the length of the sucked yarn. The mouthpiece releases the yarn F when the same is pulled back to be wound onto the tapered bobbin at a speed greater than that with which it is released from the rolls 11, 12, thus exhausting the reserve of yarn previously created.

Again with reference to FIG. 2, the re-attachment process of the yarn is as follows. The yarn F is pulled back, by means of the auxiliary roll 50, unwinding a certain amount and forming a loop of yarn inside the mouthpiece 40, shown by the dash-point line, whose minimum length can be measured by an inner pair of sensors 42, so to ensure a sufficient tension on the yarn F and a suitable reserve, as shown in the enlarged detail.

The dimension of the yarn reserve can also be enlarged, to operate with greater tranquillity, considering that the auxiliary roll 50—according to a preferred variation of the embodiment of the present invention—is equipped with driving means for operating at substantially higher rates than those of the normal collection.

After reattachment, the extraction rolls 11,12 extract the yarn F at a constant and pre-established rate. The tapered bobbin 25 is not yet in contact with its driving roll 29, but is driven by means of the auxiliary roll 50, which effects an acceleration to reach the closest possible rate to the standard collecting rate, subsequently returning the tapered bobbin to its normal operation. The yarn runs from the rotor 8 to the tapered bobbin 25 at a rate in the order of 200 meters per minute.

A substantial yarn reserve is necessary at this point, to compensate a certain non-uniformity between the various spinning stations, avoiding tears. With a sucking mouthpiece without yarn-presence sensors and therefore lacking indication of the dimension of the loop in its interior, the recovery of this reserve would be left to the "reeling tension" alone, i.e. to the small difference in rate between extraction and collection. The recovery of a yarn reserve having the right dimension for a correct procedure can therefore require significant time during which the sucking mouthpiece is left in position, thus prolonging the time of each intervention of the trolley C and negatively affecting the overall service factor of the entire spinning frame.

The procedure is completely different when the mouthpiece 40 is equipped with sensors.

After re-attachment, the auxiliary roll 50 can be driven at a rate also considerably higher than the collection rate, so as to rapidly reduce the yarn reserve in the mouthpiece 40 and, regardless of the conditions in the single spinning unit, bring the rate of the tapered bobbin as close as possible to the collection rate. According to a preferred embodiment, this result is obtained by piloting, by means of the driving unit on the service trolley, the auxiliary roll 50, as well as other parts of the service trolley, on the basis of the information supplied by the sensors 41,42, . . . which are transmitted to the same driving unit for the processing of the relevant commands.

In the recovery of the reserve and, more specifically, in its starting phase, until the innermost sensor 42 detects the presence of the yarn, i.e. the reserve yarn loop exceeds said sensor, the rate of the auxiliary roll 50 is preferably maintained considerably higher than the collection rate. When the innermost sensor 42 detects the disappearance of the yarn F, the amount of residual reserve is known, which allows the rate of the auxiliary roll 50 to re-coincide with the collection rate, within a known time, i.e. exactly when the outermost sensor 41 also detects the disappearance of the yarn F. At that moment all the parameters are known: the amount of reserve yarn, the rate of the auxiliary roll 50, the rate of the cylinder 29, the extraction rate of the rolls 11,12.

Once this last condition has been reached—rate under regime conditions and disappearance of the yarn from the sensor 41—the reserve is at its minimum and the spinning station can be put in the condition of FIG. 3.

The tapered bobbin 25 is put back into contact with its driving cylinder 29, the roll 50 has already moved away, the mouthpiece 40 is allowed to re-enter and the cycle of the trolley C, which can be removed, is terminated.

The yarn reserve F is recovered, in its short residual tract, due to the "reeling tension", i.e. the rate differential between extraction and collection; this recovery is effected in about one second. With reference to the course of the yarn F, the same is reconsigned to its normal yarn carrier 21 and restarts its normal traversing movement.

In the exemplificative embodiment of FIGS. 2 and 3, only two sensors are shown, for the sake of simplicity, an inner sensor 42, which allows the recovery of the reserve by means of the auxiliary roll 50 activated at a high rate until it emits a yarn-presence signal, and an outer sensor 41, which detects the minimum useful amount of yarn reserve, to mark the moment of reconsignment of the tapered bobbin 25 to its normal driving with the roll 29, when it stops emitting the yarn-presence signal. More sensors can in fact be installed, for example three sensors—shown in the enlarged detail of FIG. 4—for a greater regulation of the roll 50 rate during the recovery of the reserve and/or to obtain a certain tension effect on the sucked yarn, by operating on the driving of the auxiliary roll 50, until the presence of the yarn F with a loop which protrudes from the inner sensor 43 is registered.

As an alternative, resort can be made to a continuous reading system—for example with a television camera—to obtain a continuous measurement of the dimensions of the yarn reserve.

The device according to the present invention has substantial advantages with respect to the devices of the known art. It allows the formation and control of a measured reserve of yarn F, giving it a controlled tension for its winding onto the tapered bobbin 25 during the transitory phases controlled from the trolley.

The device according to the invention essentially consists of a sucking mouthpiece 40 positioned on the service trolley C, equipped with a series of sensors 41, 42, 43 for detecting the presence of the yarn, which emit yarn presence/absence signals to the control unit which drives the operating phases of the auxiliary roll 50, modulating its rate according to the extent of the dimension of the reserve of yarn F. As far as the improvement in the trolley efficiency is concerned, the time economy is relevant, obtained in the reconsignment phase of the tapered bobbin to its operating, which is in the order of three-six seconds, thus shortening the intervention cycle by 15-25%. Greater security is also obtained with respect to yarn tears during the reconsignment of the tapered bobbin, which imply repetition of the entire intervention procedure, further lowering the service factor of the entire spinning frame.

The invention claimed is:

1. A device for generating and controlling a yarn (F) reserve and for imparting a suitable tension for its winding on the tapered bobbin (25), to be installed on service trolleys (C) for open-end spinning frames, for reattachment and start-up interventions on open-end spinning units, consisting of a mouthpiece under low pressure equipped with approaching and distancing means towards the run of the yarn (F), to suck it and generate a loop of reserve yarn in its interior, the service trolley (C) being equipped with an auxiliary roll (50) for winding and unwinding operations of the yarn on the tapered bobbin (25), controlled by the control units of the trolley itself, characterized in that said sucking mouthpiece (40) is equipped with a series of sensors (41, 42, 43, . . . ) for detecting the presence of the yarn in its interior to reveal the dimension of the loop of reserve yarn (F) and consequent piloting of the driving of the auxiliary roll (50) in the reattachment procedure and reconsignment phase of the tapered bobbin (25) in formation on its normally operating cylinder (29) wherein the auxiliary roll (50) is equipped with piloting means for driving at higher rates with respect to the normal rates for the collection of the yarn (F).

2. The device for generating and controlling a yarn (F) reserve according to claim 1, characterized in that the position of an inner sensor (42) delimits the driving field of the auxiliary roll (50) at higher rates.

3. The device for generating and controlling a yarn (F) reserve according to claim 1, characterized in that the position of the outer sensor (41) delimits the driving field of the auxiliary roll (50) and determines the re-consignment time of the tapered bobbin (25) to its normal functioning with the collecting roll (29).

4. The device for generating and controlling a yarn (F) reserve according to claim 1, characterized in that the driving unit on the trolley is connected to the sensors (41, 42, . . . ), which transmit to the same the data collected to elaborate the driving commands to the auxiliary roll (50).

5. The device for generating and controlling a yarn (F) reserve according to claim 1, characterized in that the sensors (41, 42, . . . ) are of the optical type made up of pairs of elements, in which there is a source ($\mathbf{41}_S$, $\mathbf{42}_R$, . . . ) and a receiver ($\mathbf{41}_R$, $\mathbf{42}_R$, . . . ).

6. A device for generating and controlling a yarn (F) reserve and for imparting a suitable tension for its winding on the tapered bobbin (25), to be installed on service trolleys (C) for open-end spinning frames, for reattachment and start-up interventions on open-end spinning units, consisting of a mouthpiece under low pressure equipped with approaching and distancing means towards the run of the yarn (F), to suck it and generate a loop of reserve yarn in its interior, the service trolley (C) being equipped with an auxiliary roll (50) for winding and unwinding operations of the yarn on the tapered bobbin (25), controlled by the control units of the trolley itself, characterized in that said sucking mouthpiece (40) is equipped with a television camera for detecting the presence of the yarn in its interior to reveal the dimension of the loop of reserve yarn (F) and consequent piloting of the driving of the auxiliary roll (50) in the reattachment procedure and reconsignment phase of the tapered bobbin (25) in formation on its normally operating cylinder (29) wherein the auxiliary roll (50) is equipped with piloting means for driving at higher rates with respect to the normal rates for the collection of the yarn (F).

7. The process for generating and controlling a yarn (F) reserve and imparting to the same a suitable tension for its winding onto the tapered bobbin (25), with organs situated on a service trolley (C) for open-end spinning frames, for reattachment and start-up interventions on open-end spinning units, comprising the phases of drawing a sucking mouthpiece (40) near the course of the yarn (F), sucking it and generating in its interior a loop of reserve yarn, and activating an auxiliary roll (50) for the winding and unwinding operations of the yarn on the tapered bobbin (25), operated by the driving units of the trolley (C), characterized in that the reattachment and start-up operations together with the re-consignment of the tapered bobbin (25) in formation on its normal operating cylinder (29) are effected on the basis of the detection of the dimension of the loop of reserve yarn (F), generated by a sucking mouthpiece (40) effected by a series of sensors (41, 42, 43, . . . ) for revealing the presence of the yarn in its interior.

8. The process for generating and controlling a yarn (F) reserve according to claim 7, characterized in that the auxiliary roll (50) operates at rates higher than those of the normal collection of the yarn (F) until an inner sensor (42) emits a signal indicating the presence of the yarn, said sensor delimiting the driving field of the auxiliary roll (50) at said higher rates.

9. The process for generating and controlling a yarn (F) reserve according to claim 7, characterized in that the outer sensor (41) delimits the driving field of the auxiliary roll (50) and determines the re-consignment time of the tapered bobbin (25) to its normal functioning with the roll (29).

10. The process for generating and controlling a yarn (F) reserve according to claim 7, characterized in that the sucking mouthpiece (40) is brought close to and away from the yarn (F) run in the tract between the extraction cylinders (11, 12) and the yarn sensor (15).

11. The process for generating and controlling a yarn (F) reserve and imparting to the same a suitable tension for its winding onto the tapered bobbin (25), with organs situated on a service trolley (C) for open-end spinning frames, for re-attachment and start-up interventions on open-end spinning units, comprising the phases of drawing a sucking mouthpiece (40) near the course of the yarn (F), sucking it and generating in its interior a loop of reserve yarn, and activating an auxiliary roll (SO) for the winding and unwinding operations of the yarn on the tapered bobbin (25), operated by the driving units of the trolley (C), characterized in that the re-attachment and start-up operations together with the re-consignment of the tapered bobbin (25) in formation on its normal operating cylinder (29) are effected on the basis of the detection of the dimension of the loop of reserve yarn (F), generated by a sucking mouthpiece (40) effected by a television camera for revealing the presence of the yarn in its interior thus obtaining a continuous measurement of the yarn reserve dimension.

* * * * *